US006491434B2

(12) United States Patent
Hafer

(10) Patent No.: US 6,491,434 B2
(45) Date of Patent: Dec. 10, 2002

(54) FLEXIBLE CONTAINER WITH SUPPORTING SIDE BEAMS

(76) Inventor: Harold F. Hafer, 26572 Morena Dr., Mission Viejo, CA (US) 92691

( * ) Notice: Subject to any disclaimer, the term of this patent is extended or adjusted under 35 U.S.C. 154(b) by 0 days.

(21) Appl. No.: 10/124,879

(22) Filed: Apr. 17, 2002

(65) Prior Publication Data

US 2002/0110292 A1 Aug. 15, 2002

Related U.S. Application Data

(63) Continuation of application No. 09/898,644, filed on Jul. 3, 2001, which is a continuation of application No. 09/422,016, filed on Oct. 21, 1999, now Pat. No. 6,287,003, which is a continuation-in-part of application No. 09/252,137, filed on Feb. 18, 1999, now Pat. No. 6,113,270, which is a continuation-in-part of application No. 09/061,740, filed on Apr. 16, 1998, now Pat. No. 5,897,211.

(51) Int. Cl.[7] ..... B65D 33/02

(52) U.S. Cl. ..... 383/119; 383/67; 383/903; 220/9.1

(58) Field of Search ..... 383/119, 67, 903; 220/9.1

(56) References Cited

U.S. PATENT DOCUMENTS

| | | | | | |
|---|---|---|---|---|---|
| 4,901,885 | A | | 2/1990 | Boots | |
| 5,025,925 | A | | 6/1991 | Wiklund | |
| 5,071,025 | A | | 12/1991 | Boots | |
| 5,289,937 | A | | 3/1994 | Boots | |
| 5,897,211 | A | * | 4/1999 | Hafer et al. | 383/119 |
| 6,004,035 | A | * | 12/1999 | Hafer et al. | 220/9.1 |
| 6,113,270 | A | * | 9/2000 | Hafer | 220/9.1 |
| 6,287,003 | B1 | * | 9/2001 | Hafer | 220/9.1 |

* cited by examiner

*Primary Examiner*—Jes F. Pascua
(74) *Attorney, Agent, or Firm*—Domingue & Waddell, PLC

(57) ABSTRACT

A flexible bulk shipping container having supporting side beams positioned vertically about the side wall panel of the container. The side beams are made of a rigid material and act to distribute lateral bulge forces evenly throughout the container to prevent bulging.

5 Claims, 13 Drawing Sheets

FLEXIBLE CONTAINER WITH SUPPORTING SIDE BEAMS

This application is a contituation of application Ser. No. 09/898,644 filed Jul. 3, 2001, which is a continuation of appilication Ser. No. 09/422,016 filed Oct. 21, 1999 which is a CIP of application Ser. No. 09/252,137 filed on Feb. 18, 1999, which is a CIP of Ser. No. 09/061,740 filed on Apr. 16, 1998.

FIELD OF THE INVENTION

The present invention relates to bulk containers, and in particular, flexible bulk containers having supporting vertical side beams which prevent bulging of the container when loaded with flowable materials.

BACKGROUND OF THE INVENTION

To store and transport flowable materials such as grain, chemicals, fertilizers and minerals, intermediate or semi bulk shipping containers have been developed. These containers are often cylindrical in design and are formed from a flexible woven material. Approximately 1,000 to 3,000 lbs. or more of bulk material may be loaded within the containers which customarily have top loading and bottom discharge features. Flexible intermediate bulk containers are easily transported and stored in an exposed condition and can be readily stacked for high density storage or transportation.

U.S. Letters Patent No. 4,194,652 describes a flexible intermediate bulk shipping container. A woven container is provided which includes a bottom portion and an upstanding side portion. The side portion is formed from one or more panels sewn together at the vertical edges. The lower edge of the cylindrical side portion is sewn to the periphery of the bottom portion, which includes a discharge spout. A similar spout is situated at the top of the container to facilitate in the loading thereof.

As a result of the inherent properties of flowable or bulk material, a lateral force generated by the bulk material is exerted upon the side wall panels of flexible bulk containers. Flexible circular side walls tend to uniformly distribute the lateral force caused by the bulk material about the containers. However, the lateral force tends to cause a bulging of the container. Bulging is an undesired effect as it distorts the containers causing a loss of storage space when the containers are stacked together. In the extreme, bulging can cause rupture of the container and a spilling of the container's contents. This is especially undesirable when the contents are chemical in composition.

Transportation, be it by truck, train or ship, subjects flexible containers to forces of momentum. Hence, acceleration or deceleration of the transporting vehicle may cause a shifting of the contents of the containers and of the container themselves. To ease some of the problems associated with transportation, flexible intermediate bulk containers have been developed with rigid supporting members.

U.S. Letters Patent No. 5,025,925 describes a flexible intermediate bulk container flexible container having support pillars associated therewith. The outer surface of the container has vertically placed channels which receive the support pillars. The bottom ends of the support pillars are connected to a wooden pallet. The patent describes that the pillars are useful in reducing strain placed upon the upper end of the forward support pillars and the lower end of the backward support pillars when transport velocity is reduced.

U.S. Letters Patent No. 4,019,635 describes a tubular cardboard or corrugated board bulk intermediate container which rests within a sleeve that is secured to a bottom pallet. The patent further describes that the relative movement of the container within the sleeve provides for the absorption of a large proportion of the impact energy resulting from transportation of the container.

Because flexible intermediate bulk containers are collapsible, attempts have been undertaken to create self standing side walls to ease in the filling of the container.

U.S. Letters Patent No. 4,903,859 describes a flexible intermediate bulk container which incorporate rigid panels into the side walls of the container. The patent describes that the rigid panels permit the container to stand alone when filled.

While employing some form of supporting structure, the aforementioned patents do not address or attempt to alleviate the problem of container bulging.

One attempt to overcome the problems associated with bulging involves the placement of flexible containers within a rigid outer cubical frame work structure. Examples of such applications are found in the following patents: U.S. Letters Patent Nos. 5,437,384; 4,834,255; 4,901,885; 4,927,037; 5,052,579; 5,071,025; 5,282,544; 5,289,937; and 5,407,090. However, this approach is burdensome, expensive and complicated as it requires the construction of an external supporting structure.

It is therefore an object of the present invention to overcome the drawbacks associated with bulging of flexible bulk containers under load. This object is achieved through the use of vertical side beams positioned about the side wall panel of the flexible bulk container.

SUMMARY OF THE INVENTION

The object of the present invention is achieved by providing a flexible bulk container having vertically placed rigid side beams positioned about the side wall panel of the container. The side beams are connected at the top and at the bottom of the container in such a manner that the side beams bear the lateral forces of the flowable materials being contained and transfer those forces vertically to the top and bottom of the container as well as horizontally to the side wall panel.

The rigid side beams may be formed in a variety of shapes and may be composed of numerous materials. However, the shape and composition of the rigid side beams should function to transfer force longitudinally with relatively little deflection. A preferred shape for the rigid side beams is a triangular or V shaped profile as the material to strength ratio makes tis shape economically feasible. A 45 degree angle at the apex is preferred, with the apex preferably pointing towards the center of the container. A commercially available product known as "angle is board" or "edge board" would be suitable for constructing the side beams. It has a V shaped profile and is made of paper fiber or plastic.

The side beams may be held in place by a variety of fastening mechanisms. The use of an adhesive to affix the side beams to the side wall panel of the container may be employed. Additionally, the side wall panel may contain sleeves or pockets which receive the side beams and hold them in position about the side wall panel. Laminating the side beams to the side wall panel is also possible. In an alternative embodiment of the invention in which the container has a rigid top and bottom panel, molded receptacles in the top and bottom panels may be provided to secure the ends of the side beams and position them vertically about the side wall panel.

The spacing and number of side beams is dependent on the characteristics of the flowable material that is to be contained. Ideally, the spacing and number of side beams should result in the container being relatively cubical in appearance with bends in the side wall panel occurring between side beams and at the corners of the container. This is often accomplished by using eight side beams paired into sets of two which are spaced equidistant from the other sets about the side wall panel. The side beams act to transfer the lateral bulge force to the areas in the side wall panel where the bends occur. More importantly, the side beams transfer the lateral bulge force away from the side wall panel to the top of the container. This is accomplished by connecting the top ends of the side beams at or near the top panel of the container.

The flexible bulk container of the present invention can be made inexpensively from standard bulk packaging material. When the container is empty, it is fully collapsible and therefore economical to ship. When the container is filled with flowable materials, it conforms to a relatively cubical shape essentially eliminating the problems associated with a "bulged" container and provides a more efficient bulk shipping and storage container. Additionally, the flexible bulk container of the present invention has improved stacking capabilities when loaded as a result of more evenly distributed forces and the added strength of the side beams.

In the most preferred embodiment of this application, a flexible container consist of a top panel having four sides and an upstanding side wall forming four sides, with the upstanding side wall being attached to the top panel. The upstanding side wall panel has an inner portion and an outer portion. Also included is a bottom panel that is attached to the upstanding side wall panel. The top panel upstanding side wall and bottom panel form a chamber containing a flowable material, with the material creating a force acting against the upstanding wall. Also included will be eight side posts disposed about the inner portion of the upstanding side wall providing an octagon resistance pattern to the force exerted by the flowable materials. The octagon resistance pattern effects an equal diversion of the lateral bulge force about the side wall panel by providing lateral support for the container to prevent bulging thereof when the chamber contains flowable materials. This embodiment may be used especial for use with flowable materials such as liquids. Of course, bulk materials may also be placed therein.

This embodiment will also consist of sleeve means for retaining the eight side posts in an upright position. The sleeve means comprises a series of pockets formed on each of the inner upstanding side walls and the eight side posts are inserted within these inner pockets. In one embodiment, the eight side posts are formed in sets of two, and the side posts are interconnected. When the container is filled, the top and bottom ends of the post contact the top and bottom panel thereby allowing the transfer of lateral force from the side beam to the top and bottom panel in the octagon resistance pattern.

The container may also include a bag disposed within the chamber, with the bag having the flowable materials disposed therein. In another embodiment, the top panel may contain an opening therein. Also, the sleeve means may comprise an upper band attaching an upper end of the side beam to the inner upstanding side wall and a lower band attaching a lower end of the side beam to the inner upstanding side wall.

An advantage of the present invention includes the transferring of the bulge force to the top and bottom panels to prevent bulging. Another advantage is the use of multiple side beams that are all interconnected. Yet another advantage is the use of individual side post that may be in a set of two, with the two side posts of the set being interconnected.

Another advantage is that the most preferred embodiment of this application is particularly suited for flowable materials such as liquids. Another advantage is the ability of the present invention to self right itself in the case where the container is jolted, jarred or moved. Yet another advantage is that the novel design provides resistance to toppling. Another advantage is the placement of the side post in the inner portion of the chamber.

A feature of the present invention is the employment of the octagon force resistance pattern. Another feature of the present invention is the placement of a pair of side beam members about each inner side wall, with the side beam members being properly spaced to provide for the octagon force resistance pattern.

Yet another feature of the invention indudes connecting the top and bottom of the side beam members to each of the two adjacent side beam members. Still yet another feature is that the side beam members effect an equal diversion of the lateral bulge force about the side wall panel by providing lateral support for the container to prevent bulging thereof when the chamber contains the flowable materials. Another feature is the use of inner pockets which support the side beams in a substantially vertical position which in turn allows the diversion of the lateral bulge force.

DETAILED DESCRIPTION OF PREFERRED EMBODIMENTS

Figure 1:
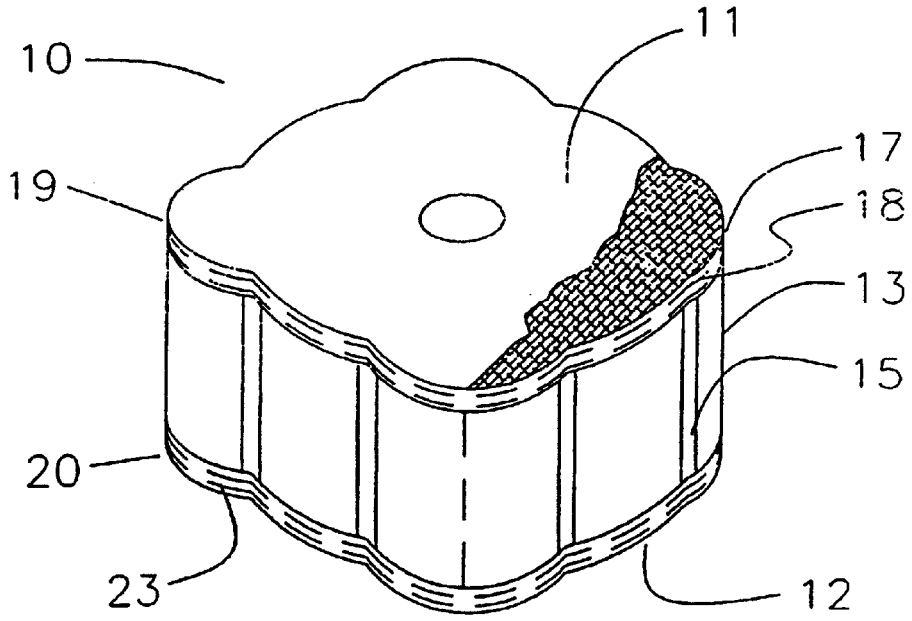
FIG. 1 is an isometric, cut away view of a first embodiment of the flexible bulk container showing side beams positioned with top and bottom sleeves

With reference to the figures where like elements have been given like numerical designation to facilitate an undstanding of the present invention, and particularly with reference to the embodiment of the bulk container of the present invention illustrated in FIG. 1, the bulk container may be constructed of a substantially flexible container 10 having a top panel 11 and a bottom panel 12 interconnected by an upstanding side wall panel 13 defining a collapsible chamber 14 for flowable materials. Preferably, four or more side beams 15 extend in a substantially vertical direction about side wall panel 13 in spaced relation.

Flexible container 10 may be partially formed of a flexible material. As an example, side wall panel 13 may be formed of a flexible material and top panel 11 and/or bottom panel 12 may be formed of a relatively rigid material. Preferably, flexible container 10 is constructed entirely of a flexible material.

The flexible material forming flexible container 10 may be a woven material, and in particular, a woven polypropylene material or a woven polyethylene material. However, it is to be understood that other flexible materials may be utilized in constructing flexible container 10. For example, flexible container 10 may be formed of a paper material or a synthetic material. Examples of synthetic materials may include plastics or rubber.

Flexible container 10 may be formed of multiple layers. For example, flexible container 10 may be composed of a layer of relatively permeable woven material and a layer of relatively impermeable material. The relatively impermeable material may be an external or internal coating. Preferably, the relatively permeable woven material is a woven polypropylene material, and the relatively impermeable material is a synthetic film material. Examples of synthetic film material include nylon, polyethylene, polypropylene, polyvinyl chloride and polyesters.

Figure 2:
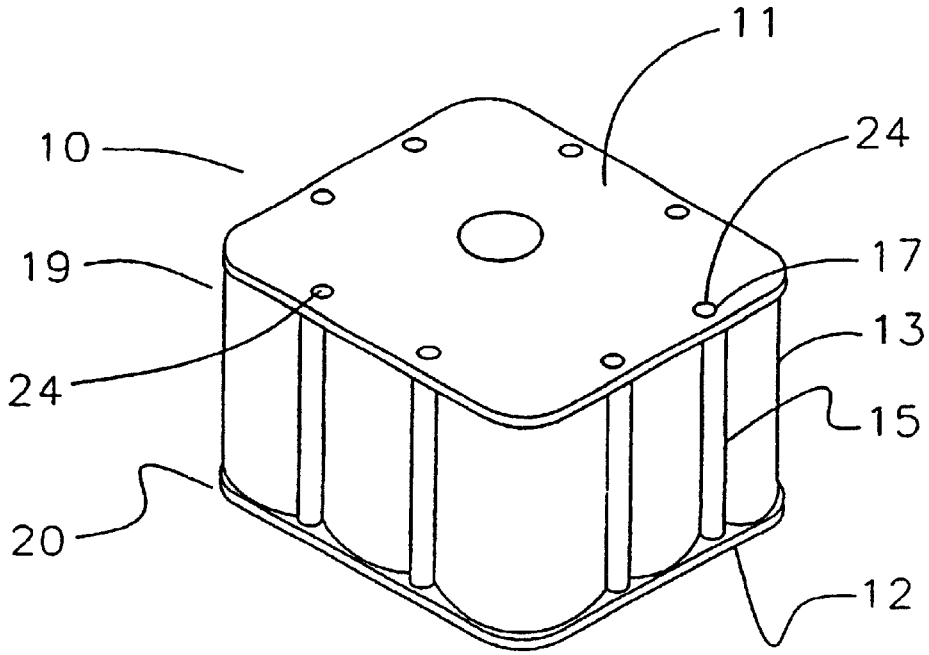
FIG. 2 is an isometric top view of a second embodiment of the flexible bulk container showing a rigid top and bottom panel.

As shown in FIG. 2, top panel 11 and/or bottom panel 12 may be constructed of a substantially rigid material. While it is understood that various material having rigidity may be utilized to construct top panel 11 and/or bottom panel 12, it is preferred if the rigid material is corrugated paper, wood, plastic or metal.

With reference to FIG. 1, it can be seen that side wall panel 13 may be a formed of a single panel joined together at its ends. Alternatively, side wall panel 13 may be formed of separate side wall panels which are joined together to form side wall panel 13. As an example, side wall panel 13 may be constructed from four separate side wall panels. The separate side wall panels are preferably joined together at their respective ends to adjacent separate side wall panels. It is to be understood that side wall panel 13 may be joined by any fastening procedure. The fastening procedure would depend upon a variety of construction factors, as for example, the type of material utilized to form side wall panel 13. However, in an embodiment in which side wall panel 13 is made of a woven material, it would be preferred if the fastening procedure was accomplished through sewing or stitching.

Again with reference to FIG. 1, it is preferred if the number of side beams 15 is between four and twelve. It is even more preferred if the number of side beams 15 is eight. Side beams 15 may also be in sets of two. When configured in sets of two, it is preferred if the sets of side beams 15 are positioned opposite each other about side wall panel 13.

Figure 3:
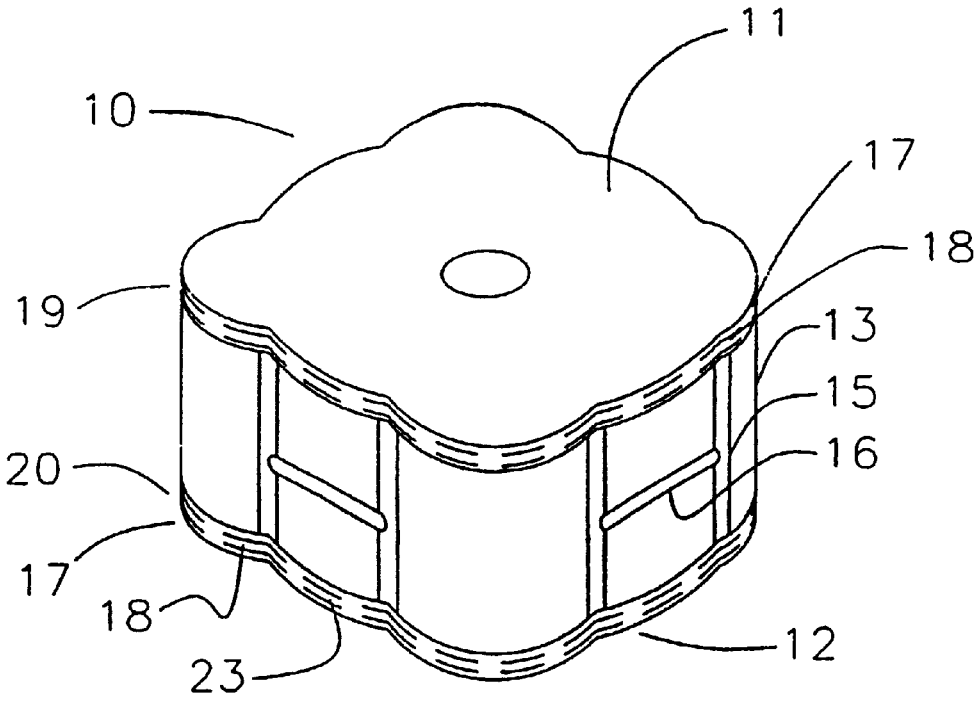
FIG. 3 is an isometric top view of a third embodiment of the flexible bulk container showing an interconnection between sets of side beams.
Figure 4:
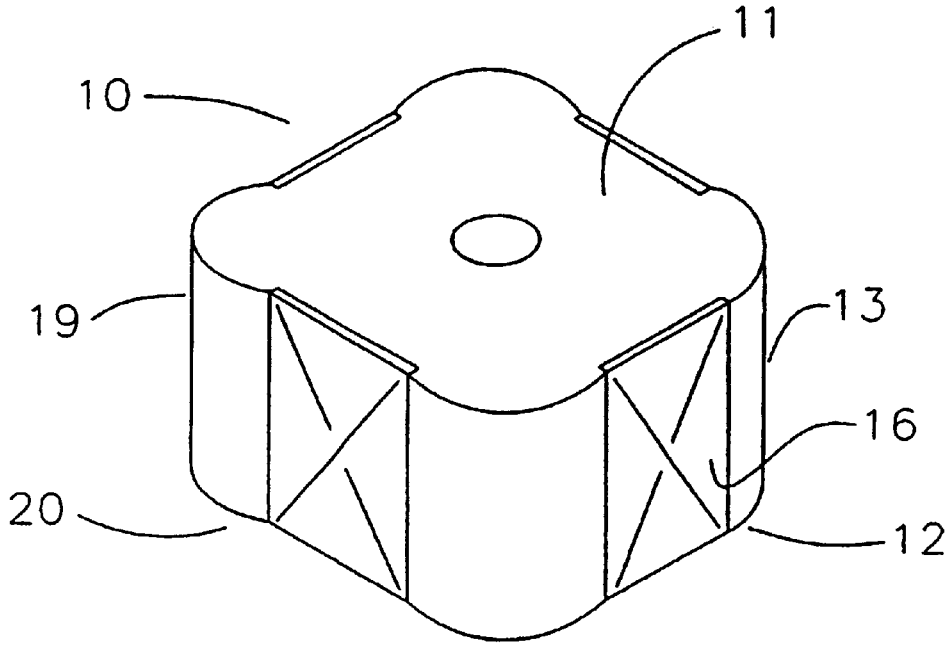
FIG. 4 is an isometric top view of a third embodiment of the flexible bulk container showing the side beams as plates.

As illustrated in FIG. 3, side beams 15 forming the sets of side beams 15 may be interconnected. The sets of side beams 15 may be interconnted with any type of connecting member 16. Connecting member 16 is preferably made of the same material forming side beams 15. Connecting member 16 may be a rod, tube or similar designed device, and its placement between side beams 15 forming the set of side beams may be in any configuration or angle. In a preferred embodiment, connecting member 16 is of a design such that interconnected side beams 15 form a plate, as shown in FIG. 4

FIG. 1 shows side beams 15 extending substantially vertically about side wall panel 13. Preferably, side beams 15 may be positioned at an angle in the range of 10 to 90 degrees in relation to bottom panel 12. More preferably, side beams 15 may be positioned at an angle in the range of 45 to 90 degrees in relation to bottom panel 12. And even more preferably, side beams 15 may be positioned at an angle of about 90 degrees in relation to bottom panel 12.

Again with further reference to FIG. 1, side beams 15 may extend substantially the entire height of said side wall panel 13. To effect distribution of the lateral bulge forces, it is preferable that side beams 15 be formed of a substantially rigid material. The rigid material forming side beams 15 may be any material having rigidity such that the distribution of lateral bulge forces is accomplished. Preferably, such rigid material is corrugated paper, wood, plastic or metal. Side beams 15 may also be designed in a variety of shapes. For example, side beams 15 may be tubular. In addition, side beams 15 may be triangular shaped or V shaped in cross section.

Bulge force is equal in all lateral directions. Hence, without the use of side beams 15 to transfer the bulge force, flexible container 10 would be circular or round. To obtain the desired cubical shaped flexible container 10 which is portrayed in the figures, side beams 15 should be positioned about side wall panel 13 in order to effect an equal diversion of lateral bulge forces. Determining the positioning of side beams 15 may involve the following consideration.

Compute the circumference of a theoretical circle using as a guide (1) the diameter of a loaded circular flexible container without side beams(no restrictions impending the lateral bulge force)and(2) including in the computation the expected elasticity or elongation of the material forming side walls panels of the container. Divide the computed circumference by the number eight (two side beams per side or eight segments which maximizes equal distribution of bulge force). The resulting number is the distance on the circumference of the flexible container 10 that side beams 15 should be positioned apart from each other. However, due to considerations such as product manufacturing tolerances and efficiencies, side beam 15 profiles, side wall panel 13 material selection, content load requirements and others, the positioning of side beams 15 does not need to be located as precisely as described above. In addition, it might be beneficial for reasons other than design (e.g., stacking, handling considerations, side beam construction) to use more than two side beams 15 per side. In this situation, side beams 15 may be positioned symmetrically about side wall panel 13. If a side beam 15 is positioned at the midpoint of a side of side wall panel 13, the positioning of other side beams 15 may be done to balance out the residual bulge force or to more efficiently handle stacking load.

In the embodiment wherein side wall panel 13 has four distinct sides, as for example when formed of four separate (but joined) side wall panels 13, one possible construction of the present invention would be to position four side beams 15 in the center of each separate side wall panel 13. In a preferred embodiment, two side beams 15 are positioned about each of the four side wall panels 13.

Side beams 15 may be positioned about side wall panel 13 in various ways. Side beams 15 may be attached directly to side wall panel 13 or side beams 15 may be directly attached to top panel 11 and bottom panel 12. The attachment means may be dictated by the type of material forming flexible container 10. In the embodiment of the present invention in which side beams 15 are fixedly attached to side wall panel 13, side beams 15 may be attached by adhesive. In the embodiment of the present invention in which side wall panel 13 is made of a flexible metal, side beams 15 may be welded to side wall panel 13. In the embodiment in which side wall panel 13 is made of woven material or paper, a mechanical fastener may be utilized to accomplish attachment. An example of a mechanical fastener is a staple or stitch.

As illustrated in FIG. 1, side beams 15 may be positioned about side wall panel 13 by retaining means 17 which receive and maintain side beams 15 in a substantially vertical position in relation to bottom panel 12. Preferably, retaining means 17 are configured as sleeves 18.

Figure 5:
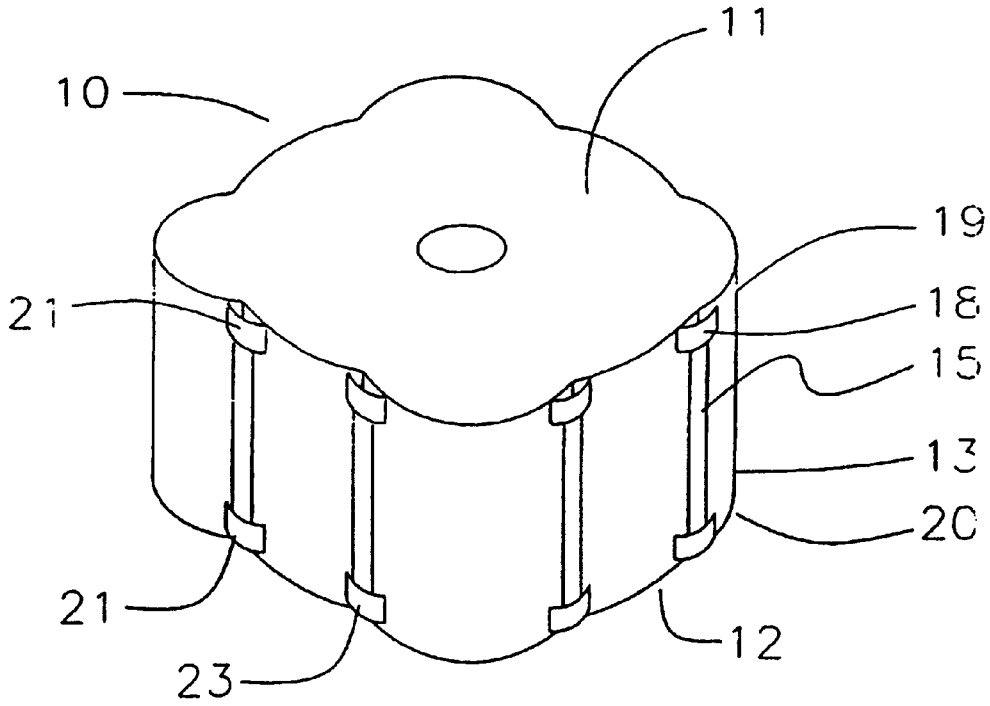
FIG. 5 is an isometric top view of a fourth embodiment of the flexible bulk container showing side beams positioned with top and bottom pockets.

Again with reference to FIG. 1, sleeves 18 may be secured to side wall panel 13. In one embodiment of the present invention, sleeves 18 are positioned at top end 19 of side wall panel 13 and bottom end 20 of side wall panel 13 whereby the ends of side beams 15 may be fixedly attached to side wall panel 13. Sleeves 18 may extend continuously around side wall panel 13 at top end 19 and bottom end 20. However, sleeves 18 may also extend noncontinuously around side wall panel 13 at top end 19 and bottom end 20. As seen in FIG. 5, sleeves 18 may preferably be in the form of multiple pockets 21 whereby a set of two pockets, one positioned at bottom end 20 and one positioned at top end 19, receive and maintain individual side beams 15 in a substantially vertical position about side wall panel 13. Instead of a set of two pockets, pockets 21 may be a single pocket extending the height of side wall panel 13 which receives one side beam 15.

Figure 6:
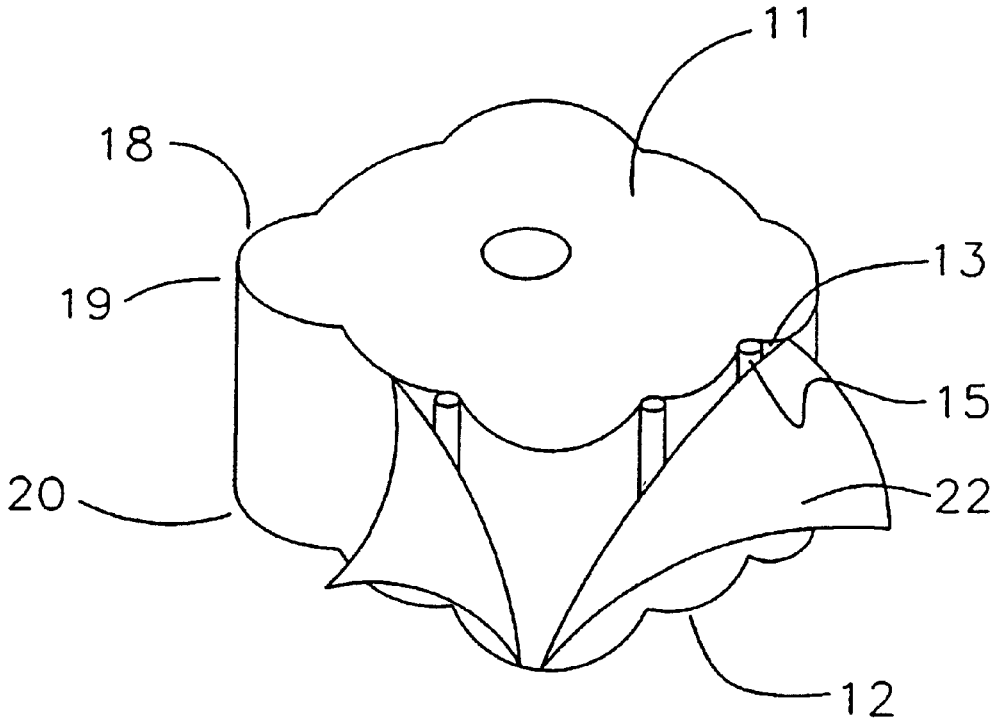
FIG. 6 is an isometric top view of a fifth embodiment of the flexible bulk container showing the side beams positioned with a laminated sheet.

In another preferred embodiment shown in FIG. 6, sleeves 18 may be in the form of sheet 22. Preferably, sheet 22 forms a laminate which substantially covers side wall panel 13 and side beams 15 as they are positioned about side wall panel 13. Sheet 22 may be fastened to side wall panel 13 by various conventional means. Moreover, sheet 22 may extend continuously around side wall panel 13 to form the laminate or sheet 22 may extend noncontinuously around side wall panel 13 to form the laminate. In the later configuration, sheet 22 may be composed of separate sheets covering portions of side wall panel 13.

Sleeves 18 may be secured to side wall panel 13 by conventional means depending on the material forming sleeves 18. For example, sleeves 18 may be made of a flexible, non-elastic material which is preferably a polypropylene material or a polyethylene material. Sleeves 18 made of a flexible, non-elastic material may be secured to side wall panel 13 by conventional fastening means, as for example, mechanical fastening. For illustrative purposes, the mechanical fastening may be stitching 23 as shown in FIG. 1.

Another preferred embodiment of the present invention is shown in FIG. 2. In this embodiment retainer means 17 attach side beams 15 to top panel 11 and bottom panel 12. Depending on the material used to form top panel 11 and bottom panel 12, various methods may be employed to attach side beams 15. For instance, in a preferred embodiment, top panel 11 and bottom panel are formed of a substantially rigid material. Hence, retainer means 17 may be molded receptacles 24 in top panel 11 and bottom panel 12 which receive respective ends of side beams 15 and maintain side beams 15 in a substantially vertical position about side wall panel 13.

Figure 7:
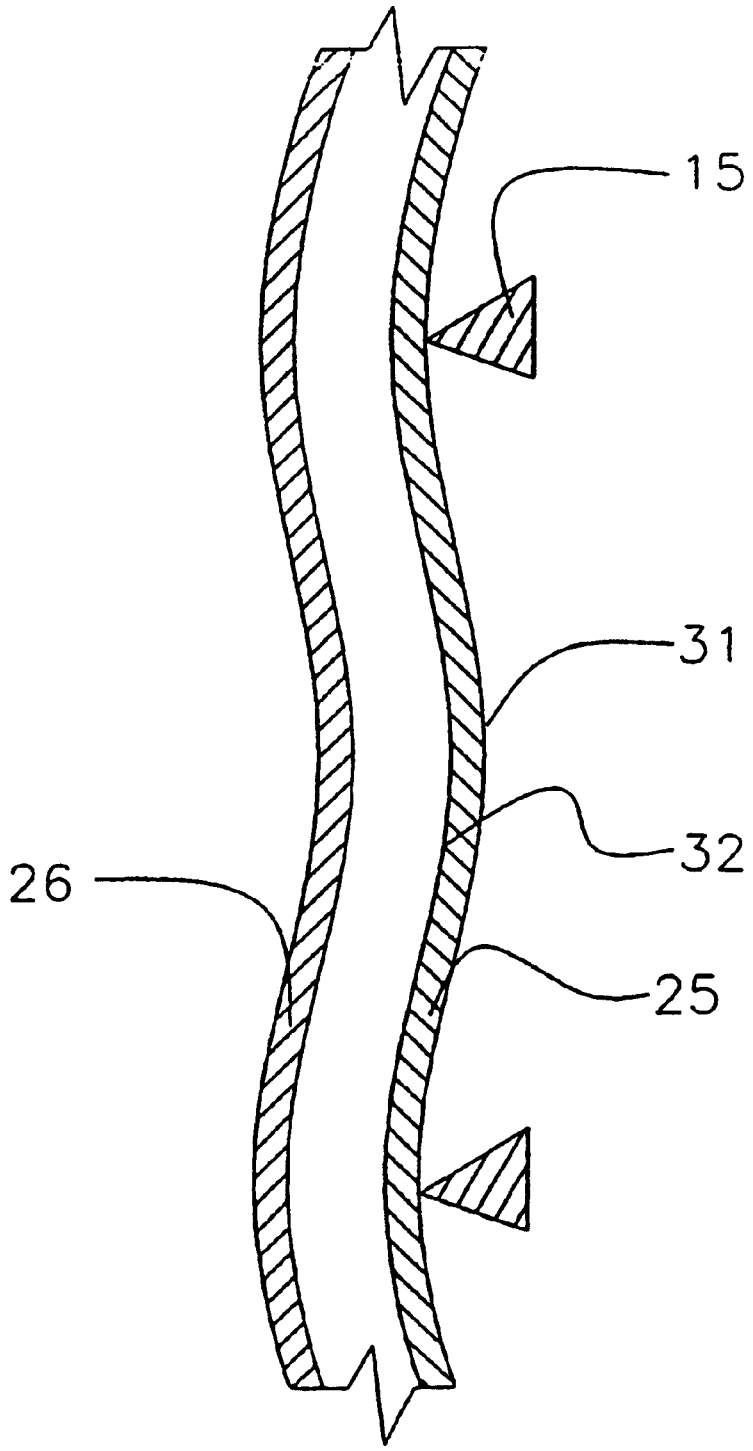
FIG. 7 is a partial cross sectional schematic view of the first embodiment of the flexible bulk container showing side beams positioned on the outer side wall surface of the container.

With reference to FIG. 7, flexible container 10 is shown as having an outer layer 25 of relatively permeable woven material and an inner layer 26 of relatively impermeable material. In this preferred embodiment, side beams 15 may be positioned or attached by retainer means 17 to outer surface 31 of outer layer 25.

Figure 8:
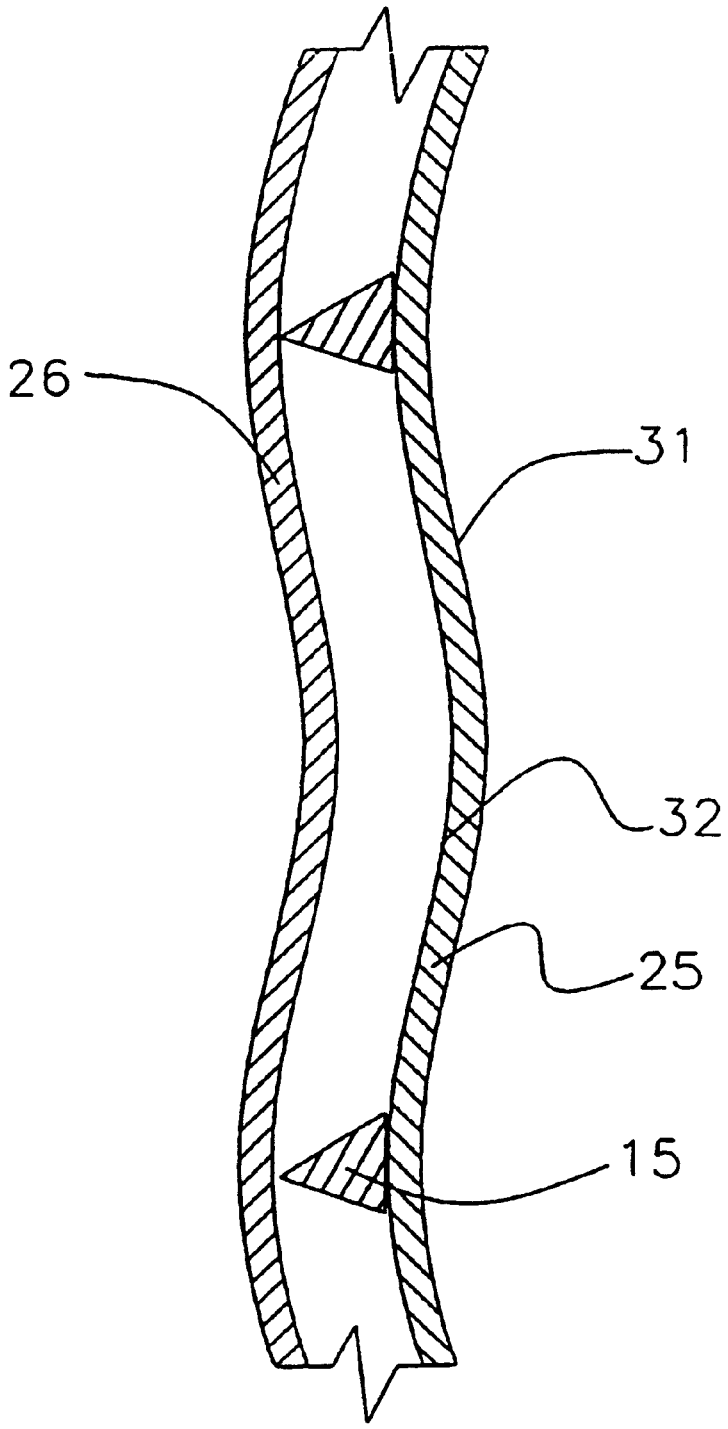
FIG. 8 is a partial cross sectional schematic view of a sixth embodiment of the flexible bulk container showing side beams positioned on the inner side wall surface of the container.

Alternatively and as shown in FIG. 8, side beams 15 may be positioned or attached by retainer means 17 to inner surface 32 of outer layer 25 adjacent to inner layer 26.

Figure 9:
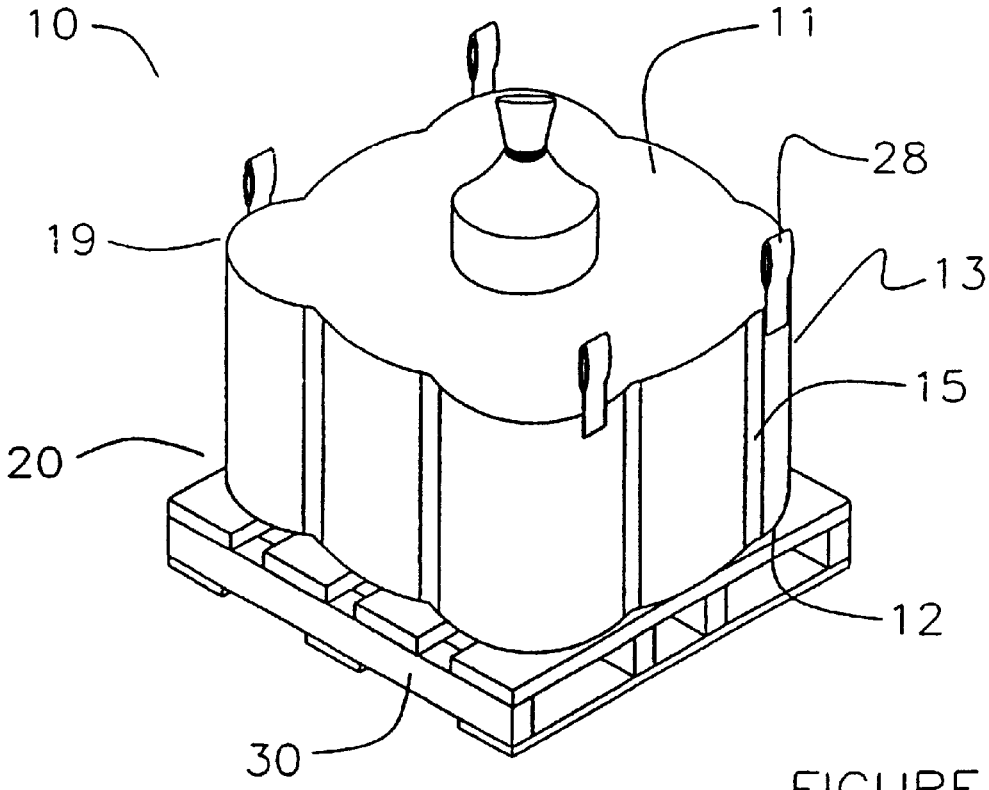
FIG. 9 is an isometric top view of a seventh embodiment of the flexible bulk container showing a top fill opening, lifting loops and a pallet.

As revealed in FIG. 9, flexible container 10 may have a selectively closable fill opening 27 situated in top panel 11 to facilitate the filling of chamber 14 with flowable materials. Flexible container 10 may also have lifting loops 28 for handling or transporting flexible container 10 by forklift. Preferably, lifting loops 28 are fastened to top panel 11 or top end 19 of side wall panel 13. A bottom pallet 30 may also be provided upon which flexible container 10 sits to aid in the transportation of flexible container 10.

Figure 10:
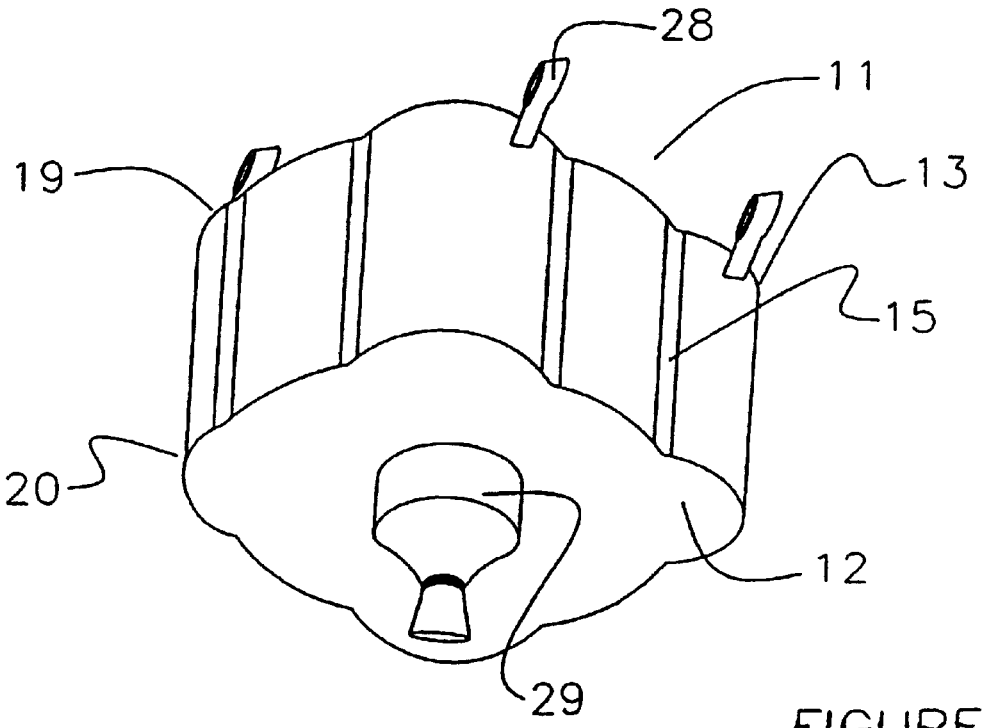
FIG. 10 is an isometric bottom view of the seventh embodiment of the flexible bulk container showing a bottom dispense opening.

As seen in FIG. 10, selectively closable discharge opening 29 may also be situated in bottom panel 12 to facilitate in the removal of the flowable materials contained within chamber 14.

Figure 11:
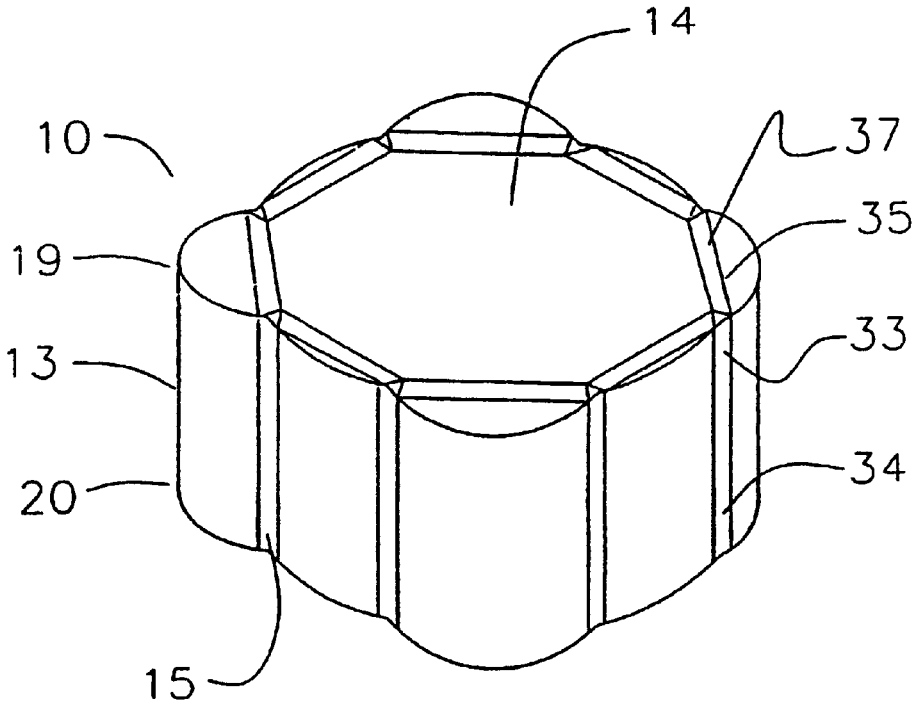
FIG. 11 is an isometric top view of an eighth embodiment of the flexible bulk container showing straps connecting the top ends of the side beams.

In another preferred embodiment depicted in FIG. 11, flexible container 10 is without top panel 11. Instead, top force distribution means 35 interconnect top ends 33 of side beams 15. Top force distribution means 35 function to evenly distribute the lateral forces caused by a load of flowable materials throughout flexible container 10 and specifically to all side beams 15. Preferably, top force distribution means 35 connect adjacent top ends 33 of side beams 15 to each other.

Figure 12:
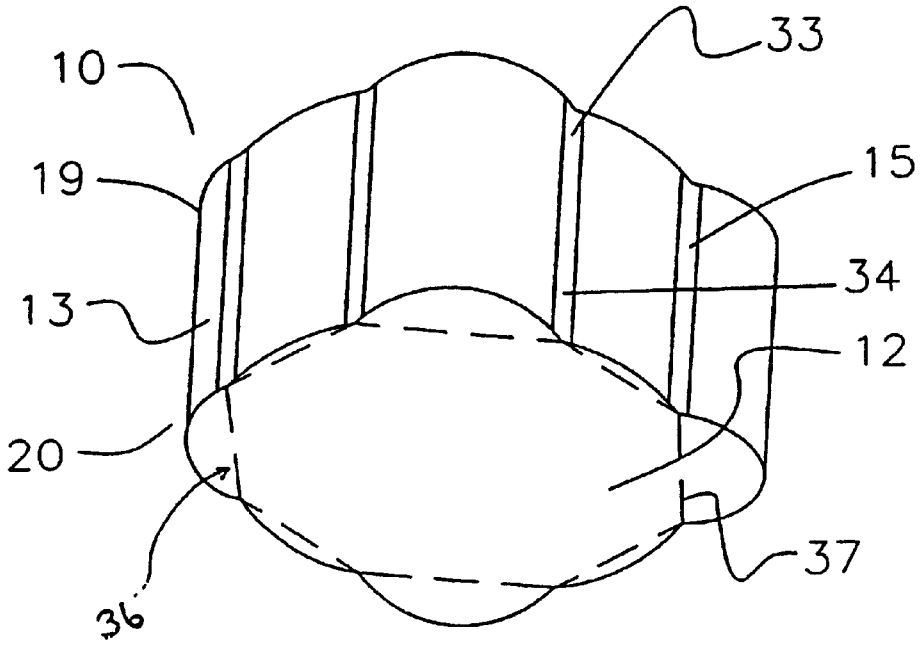
FIG. 12 is a isometric bottom schematic view of the eighth embodiment of the flexible bulk container showing the positioning of straps connecting the bottom ends of the side beams.

As shown in FIG. 12, flexible container 10 may also have bottom force distribution means 36 which interconnect bottom ends 34 of side beams 15. Similarly, bottom force distribution means function to evenly distribute the lateral forces caused by a load of flowable materials throughout flexible container 10 and specifically to all side beams 15. Preferably, bottom force distribution means connect adjacent bottom end 34 of side beams 15.

Top force distribution means 35 and bottom force distribution means 36 may be any device which provides for the interconnection of side beams 15 and function to distribute the lateral force as aforesaid. Examples may include wires and preformed rigid material. Preferably, top and bottom force distribution means 35 and 36 are straps 37 formed of a non elastic material. In the embodiment just described, retainer means 17 may also position or attach side beams 15 to side wall panel 13.

In the embodiment described above, side beams 15 are relatively restricted from moving when chamber 14 is filled with flowable materials. As a result, a force exerted in any direction on one of side beams 15 would be countered by an opposite force caused by the same force on one or more of the other side beams 15. Hence, a stabilized equal distribution of forces results. In other words, any outward bound force exerted on a side beam 15 by a force exerted by the lateral force bulge force on side wall panel 13 is transmitted to top end 33 and bottom end 34 of side beams 15 and then is transmitted through top and/or bottom force distribution means 35 and 36 to other side beams 15. Since side beams 15 are equally stressed and held in place, flexible container 10 has a fixed dimensional stability. Preferably, eight side beams are used in this embodiment, and top and bottom force distribution means 35 and 36 would resemble an octagon which would connect eight geometrical spaced side beams 15 at the top and bottom of flexible container 10 resulting in a stable condition of resistance against all directional stresses.

The bulk container of the present invention may be constructed by providing top panel 11 and bottom panel 12. Side wall panel 13 made of substantially flexible material is then connected to top panel 11 and bottom panel 12 to create a collapsible chamber 14 for flowable materials. Four or more rigid side beams 15 are positioned about side wall panel 13 in a substantially vertical position whereby side beams 15 provide lateral support for flexible container 10 to prevent bulging thereof when chamber 14 contains flowable materials. Retainer means 17, as previously described, may be utilized to accomplish the positioning of side beams 15 about side wall panel 13. The number of side beams 15 may be between four and twelve. However, eight side beams are preferred. It is also preferred if side beams 15 are provided in sets of two and are then positioned opposite another set of side beams 15 about side wall panel 13.

The present invention has utility for a variety of flexible or semi-flexible shipping containers. It is foreseen that one application of the present invention will be with flexible intermediate bulk shipping containers. Flexible intermediate bulk shipping containers are commonly made of permeable woven mail having an inner liner of impermeable material such as plastic. These containers customarily hold between 1,000 lbs. and 3,000 lbs. or more of material. Preferably, container 10 may hold about 2,000 lbs. of bulk material for a 1 to 1.5 cubic yard quantity.

Figure 13:
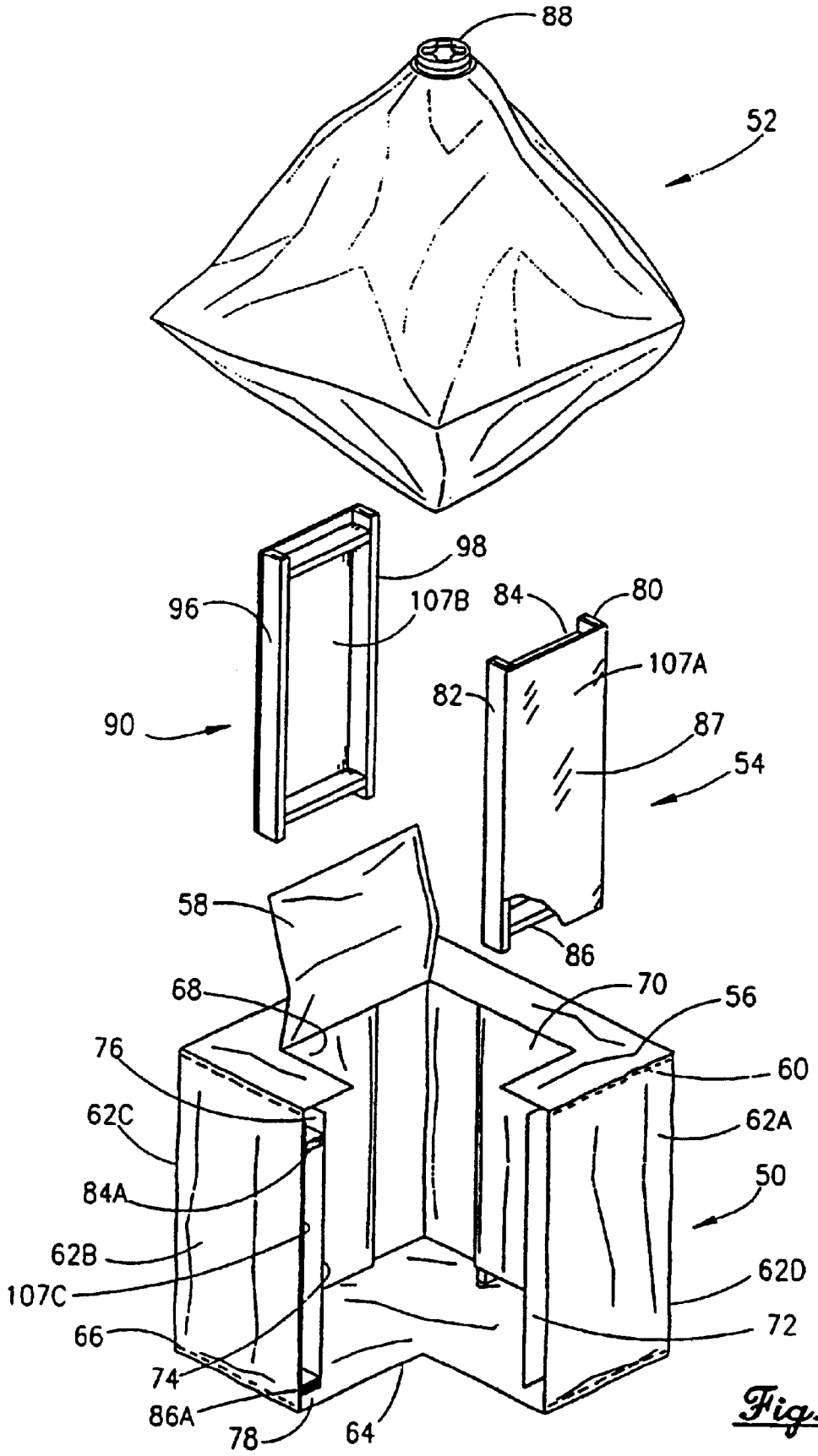
FIG. 13 is an isometric disassembled top view of the ninth embodiment of the flexible bulk container showing the container, inner bag and side beam.

Referring now to FIG. 13, the ninth embodiment of this application will now be described. This embodiment is especially applicable for liquid containers. During transportation and movement, liquid containers are susceptible to vibrating, jolting, jarring and moving due to the dynamic nature of the liquids contained therein. Thus, the prior art liquid containers can become distorted and/or deformed. The present invention solves these and other problems of the prior art.

FIG. 13 is an isometric disassembled top view of the flexible bulk container depicting the container 50, inner bag 52 and side beam member 54. The container 50 will have the top panel 56, with the top panel containing an opening therein for placement of the cover 58. The top panel 56 is generally arranged in a rectangular fashion so that the top panel has four sides.

The top panel 56 is attached by sewing to an upstanding side wall panel 62. Other means for attaching the top panel 56 to the upstanding side wall panel 62 are available such as mechanical fasteners. The upstanding side wall panel 62 will generally consist of four sides 62A, 62B, 62C, 62D.

The upstanding side wall panel 62 extends to the bottom panel 64 with the bottom panel 64 being threadedly attached 66 to the upstanding side wall panel 64. Therefore, a chamber is formed in which materials such as flowable materials, may be placed. The flowable materials may include dry, liquid and/or bulk materials. In the most preferred embodiment, the inner bag 52 is placed within the chamber with the flowable materials placed within the inner bag.

In the embodiment shown in FIG. 13, a first pocket second pocket 20, third pocket 72 and fourth pocket 74 have been added to the inner chamber. The pockets 68,70,72,74 have a first opened end, for instance end 76, and second opened end, for instance end 78 that allows the corresponding side beam member 54 to be inserted therein. The pockets 68,70, 72,74 will, therefore, be threadedly attached to the inner chamber along the longitudinal sides. It should be understood that other means for attaching the side beam 54 to the upstanding side wall panel 62 may be employed such as mechanical fasteners. The pockets may be employed either in the internal portion of the chamber or on the outer portion of the upstanding side wall panel 62.

FIG. 13 also depicts the side beam member 54. According to the teachings of the present invention, four side beam members will be placed within the four pockets provided. In the embodiment of FIG. 13, the side beam member 54 consists of a first side post 80 and a second side post 82 joined together with a cross-joining member as will be more fully explained later in the application. The length of all the side beam members and/or side posts will be slightly less than the length of the side wall panel. The side post 80, 82 may be interconnected via the cross-member 84 and cross-member 86. A single cross-member may have been used instead of two. The side beam member 54 may further contain a solid piece 87 such as from a sheet of OSB, fiberboard, plywood, etc. The solid piece 87 adds strength and stability to the side beam member 54. It should be noted that a single solid panel may be used in place of the side beam member 54. When the container is filled, the top and bottom ends of the post contact the top and bottom panel.

The side posts are interconnected together in sets so that they resist momentum forces caused by movement of the contents of the container that otherwise would topple the container. As those is of ordinary skill in the art will appreciate, the container filled with liquid is stable at rest, but once moved, the bulge forces within the container are dynamic and changing. The novel container adapts to these dynamic bulge forces by constantly equalizing these dynamic forces.

Figure 18:
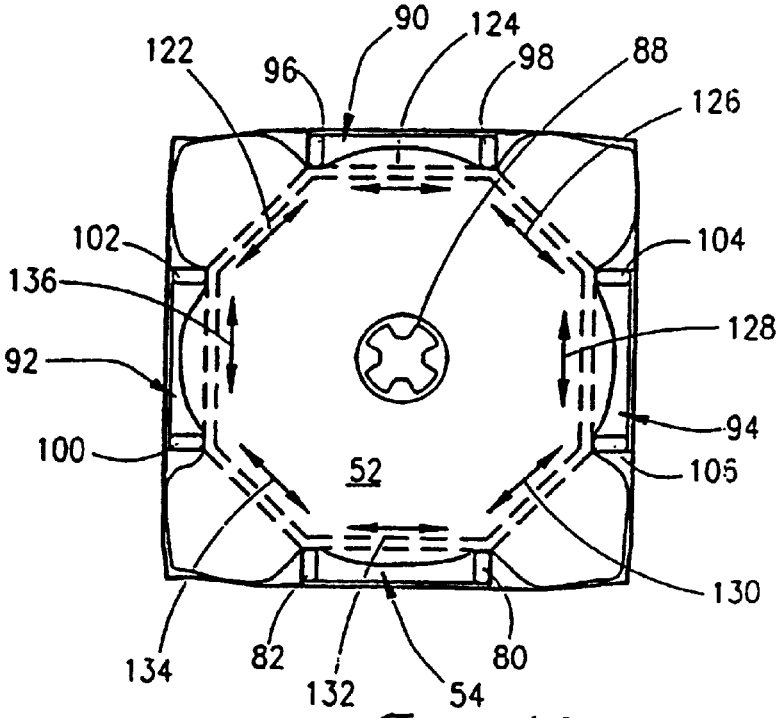
FIG. 18 is a cross section schematic view of the octagon resistance pattern taken along line A—A of FIG. 14.

The height and width of the side beam member 54 must maintain the octagon resistance pattern when the container is filled. Therefore, the distance from post 80 to post 82, in combination with the other three side beam members, provides the eight point distribution for the octagon resistance pattern. If a single solid piece 87 is used for the side beam member 54, the distance from one longitudinal end to the opposite longitudinal end is the important distance since an eight point distribution is required for the octagonal resistance pattern. In other words, a side beam member provides two distribution points and the four side beam members provide eight distribution points total. Each individual distribution point is connected to an adjacent distribution point thereby providing an eight sided octagon pattern as seen in FIG. 18.

Referring again to FIG. 13, the inner bag 52 that fits into the chamber will have an access means 88 for allowing flowable materials into and out of the bag 52. The access means 88 is usually a screw top lid or other closure device.

Figure 14:
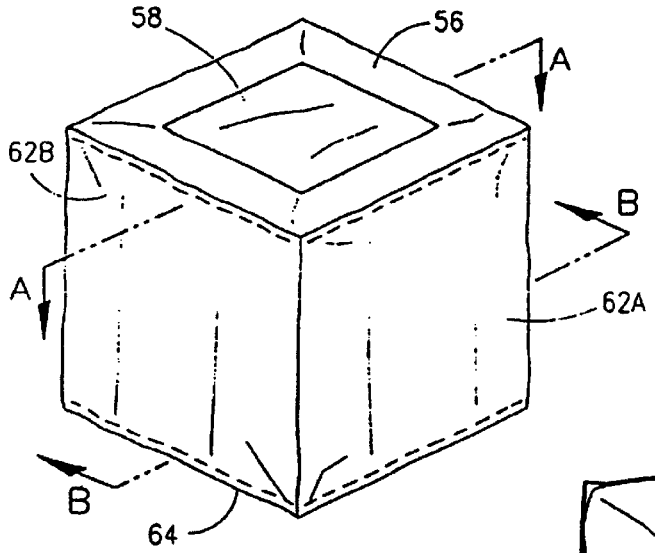
FIG. 14 is an isometric top view of the ninth embodiment of the assembled flexible bulk container.

With attention now to FIG. 14, an isometric top view of the ninth embodiment of the assembled flexible bulk container will now be described. It should be noted that like numbers in the various figures refer to like components. In this embodiment, the inner bag 52 has been inserted into the chamber, and the inner bag filled with a flowable material. The flowable material exerts a lateral bulge force acting against the upstanding side walls 62A, 62B, 62C, and 62D. The lid 58 has been closed. A substantially cubical shape is retained due to the novel teachings herein set forth. More particulatly, the octagonal resistance pattern effects an equal diversion of the lateral bulge force about the side wall panel 62 by providing an eight point lateral support for the container 50 to prevent bulging.

Figure 15:
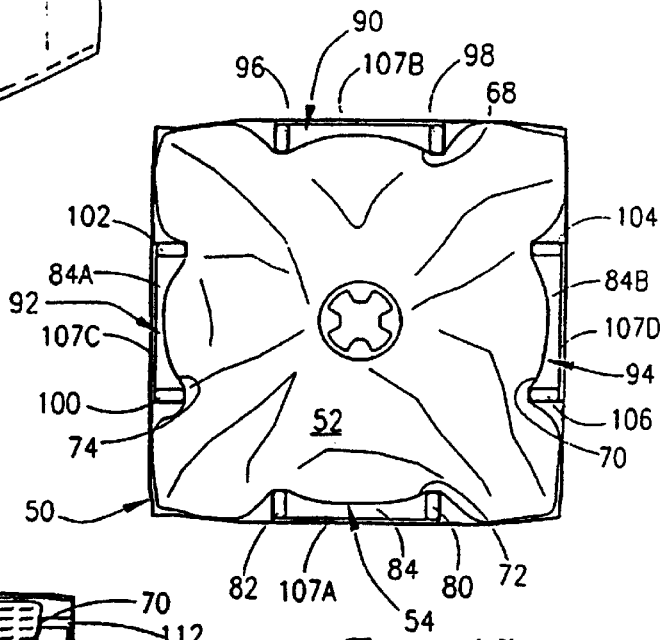
FIG. 15 is a cross sectional schematic view of the ninth embodiment taken along line A—A of FIG. 14.

In the partial cross sectional schematic view of FIG. 15, the ninth embodiment taken along line A—A of FIG. 14 will now be described. The FIG. 15 depicts the side beam member 54 as well as side beam members 90,92, and 94. The side beam member 90 contains the side post 96 and side post 98 which are interconnected as previously described. The side beam member 92 contains the side post 100 and side post 102 which are interconnected as previously described. The side beam member 94 contains the side post 104 and side post 106 which are also interconnected as previously described. The boards 107A, 107B, 107C, 107D are also included.

According to the teachings of the present invention, the eight side posts (80,82,96,98,100,102,104,106) will effect an equal diversion of the lateral bulge force about the side wall panel by effectively connecting the top and bottom of an individual side post to each of the adjacent side posts. As the flowable materials exerts the force, the force will act against the individual side posts. Since the individual side posts are interconnected to each other, the force exerted on an individual side post is in turn transferred to an adjacent side post in series about the container thereby providing the octagon resistance pattern.

For instance, a lateral force transmitted to post 96 will be transferred to post 102 via the top 56 and bottom panel 64. It follows that a force exerted on the side beam 80 is transferred to the side post 106 via the top 56 and bottom panel 64. While the force is exerted along the entire length of the post, the distribution of forces occurs at both the top end and the bottom end of the side posts. According to the teachings of the present invention, the eight posts are positioned about the upstanding wall 62 so that two side posts are positioned on each of the four sides. This arrangement connects the eight geometrical spaced side posts at the top and bottom of the flexible container 50 resulting in a stable condition of resistance against all directional stresses. The octagonal resistance pattern results in an eight sided pattern, and wherein each side of the pattern is generally equal in length. The container forms a cubical and may be stacked as will be more fully described later in the application. There are applications, however, wherein the pattern is an octagon without equal side lengths.

Figure 16:
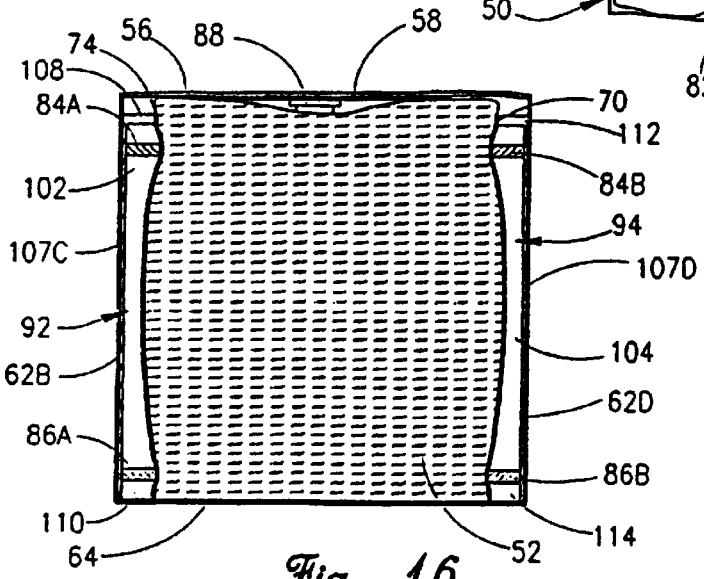
FIG. 16 is a cross sectional schematic view of the ninth embodiment taken along fine B—B of FIG. 14 showing the side beams, inner bag, and outer container.

Referring now to FIG. 16, a cross sectional schematic view of the container taken along line B—B of FIG. 14 will now be described. The FIG. 16 depicts the side beam members 92 and 94, the top panel 56, bottom panel 64, the upstanding side wall panel 62B and 62D, and inner bag 52. This FIG. 16 also shows that the side beam member 92 has a top end 108 and a bottom end 110, while the side beam member 94 has a top end 112 and bottom end 14.

Figure 17:
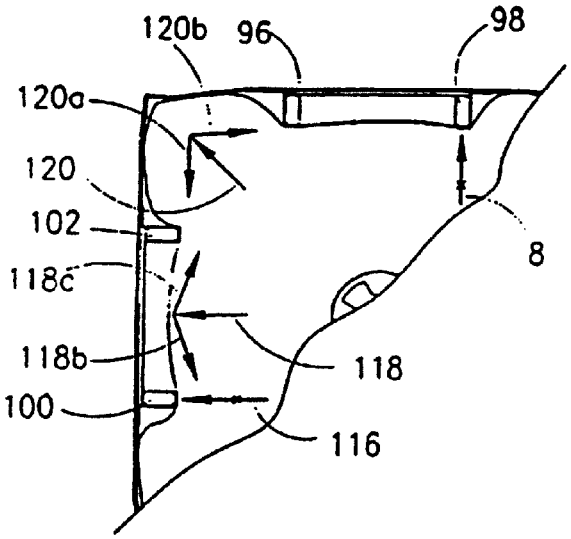
FIG. 17 is a partial cross sectional schematic view of the resultant bulk forces exerted by the flowable materials within the container.

In FIG. 17, a top partial view of the container 50 depicts the lateral bulge force represented by various force vectors. The force vector 116 will act aganist the side post 100, the force vector 118 acts between the post 100 and post 102 with the resultant force vectors 118*a* and 118*b* produced therefrom. The force vector 120 acts against the comer of the container with the resultant force vectors 120*a* and 120*b* produced therefrom The resultant force vectors are defined as the produced counter force that results on the top and bottom panel due to the octagon resistance pattern. The force vector 118*a,* due to the novel teachings of the present invention, will transfer the force to both the top 56 and bottom panel 64 which in turn will transfer to the adjacent side posts for a symmetrical distribution of forces in an octagon pattern. Likewise, the force of force vector 120 is transferred to both the top 56 and bottom panel 64 which in turn will transfer to the adjacent side posts for a symmetrical distribution of forces.

In FIG. 18, the cross sectional view of FIG. 15 is illustrated along with force distribution vectors that depict the octagon force resistance pattern accomplished by the teachings of the present invention. This is accomplished by connecting all vertical posts 80,82,96,98,100,102,104,106 together via a relatively non-elastic flexible or rigid or semi-rigid top 56 and bottom panel 64 and in effect connecting each vertical post with each of its adjacent vertical post. For instance, the resultant force vector 112 represents the force transfer between post 102 and post 96. Resultant force vector 124 represents the force transfer between posts 96 and 98; resultant force vector 126 represents the force transfer between posts 98 with 104; resultant force vector 128 represents the force transfer between posts 104 and 106; resultant force vector 130 represents the force transfer between posts 106 and 80; resultant force vector 132 represents the force transfer between posts 80 and 82; resultant force vector 134 represents the force transfer between posts 82 and 100; resultant force vector 136 represents the force transfer between posts 100 and 102. In fact, an opening may be formed in either the top or bottom panel, without destroying the octagon resistance pattern.

Thus, a force exerted in any direction on one post would be countered by an opposite force caused by the equivalent force on one or more of the other vertical post, and essentially, a stabilized equal distribution of forces results in the octagon resistance pattern when the container is filled. An application of the invention is that any outbound lateral bulge force exerted on a vertical post (as shown in FIG. 17 by force vectors 118, 120) is transmitted to the top or bottom of the post and then is transmitted through the top 56 and bottom panel 64 to the other vertical post and since the post are equally stressed and held in place, the result is a fixed dimensional stability. As previously noted, the design results in a polygon having eight sides (octagon) that connects the eight geometrical spaced vertical post at the top and bottom of the container 50 and causes a most stable condition of resistance against all directional stresses.

Figure 19:
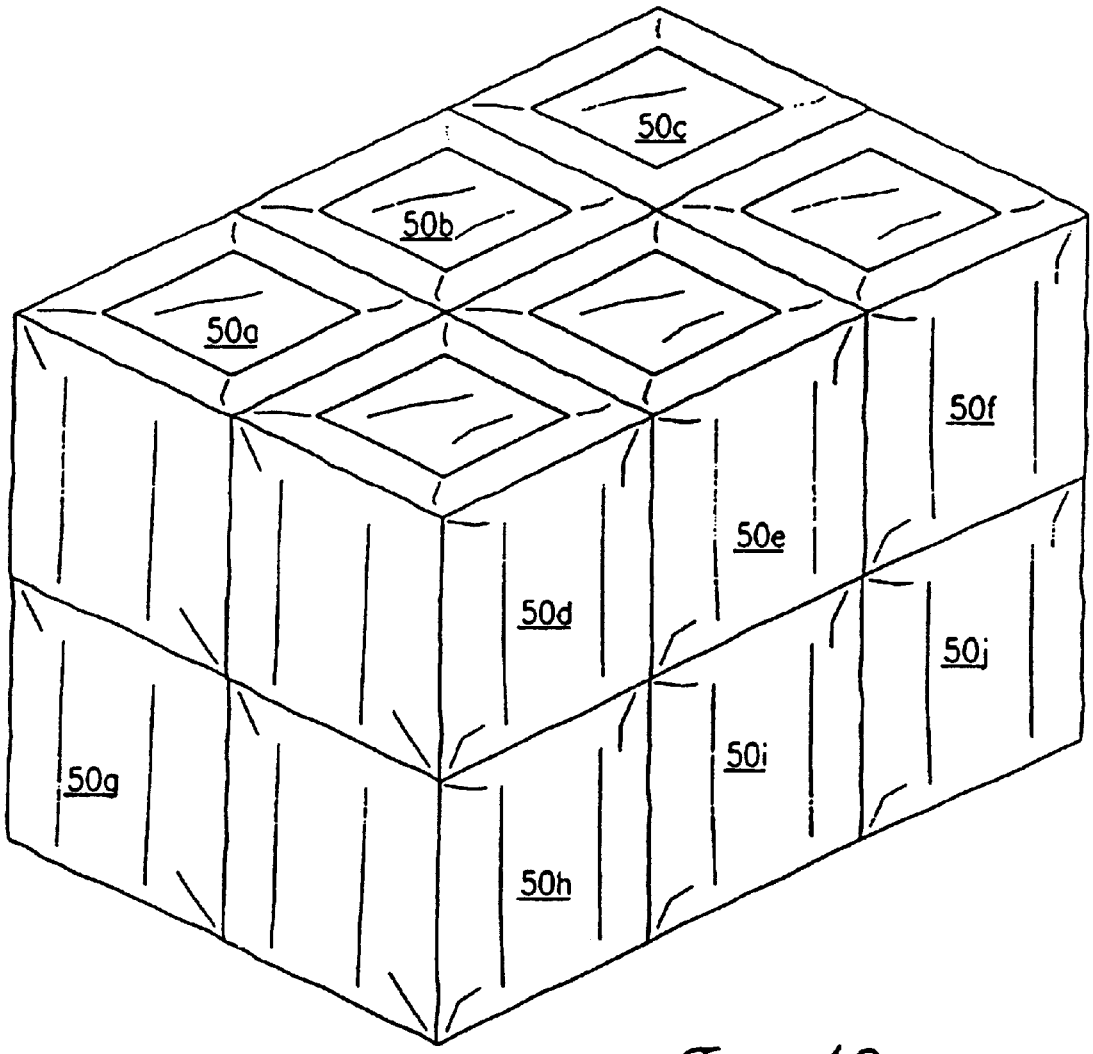
FIG. 19 is an isometric top view of a series of stacked containers according to the teachings of the ninth embodiment.

Referring now to FIG. 19, an isometric top view of a series of stacked containers according to the teachings of the ninth embodiment will now be described. Due to the novel design and construction, containers 50*a*,50*b*,50*c*,50*d*,50*e*, 50*f*, 50*g*,50*h*,50*i*,50*j*,50*k* are stacked in a series of columns and rows. The individual containers are filled with flowable materials that create a lateral force. However, the individual containers are essentially cubical in nature, and therefore, can be effectively placed next to each other without bulge interference and as a residual benefit can be stacked. Accordingly, this most preferred embodiment is particularly suited for flowable materials such as liquids, slurries and the like. In prior art designs, due to the nature of flowable materials, the container may be easily toppled or distorted due to vibrating, jolting, moving, etc. The present invention solves this problem. Also, the present invention allows for the ability of the container to self right itself in the case where the container is jolted, jarred or moved since the container retains its cubical shape. Additionally, the novel design provides resistance to toppling.

Figure 20:
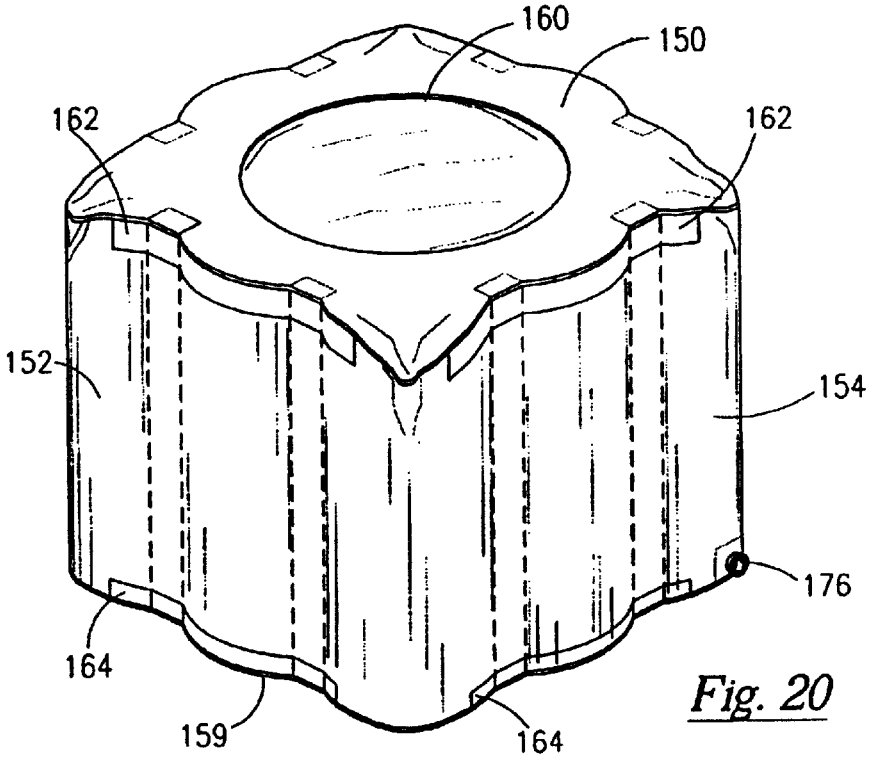
FIG. 20 is a perspective view of the tenth embodiment which is the most preferred embodiment of this application.
Figure 22:
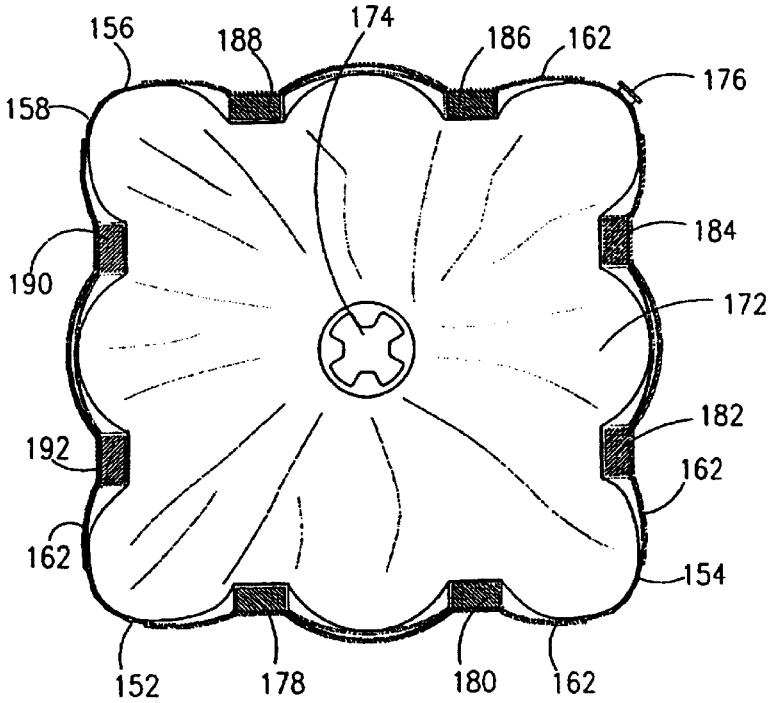
FIG. 22 is a cross-sectional view of the most preferred embodiment taken from line C—C of FIG. 21.

Referring now to FIG. 20, the most preferred embodiment of this application will now be described. FIG. 20 is a perspective view of the tenth embodiment of this application. This embodiment will also contain a top panel 150 that is attached by conventional means, such as sewing, to an upstanding side wall panel having four sides, namely and 152, 154, 156, and 158 (elements 156 and 158 are seen in FIG. 22). The four sides 152,154,156,158 are in turn attached to the bottom panel 159 thereby forming a container.

The top panel 150 contains the opening 160 that may have a flap-cover (not shown). In the most preferred embodiment of FIG. 20, a first upper outer band 162 and a second upper lower band 164 is contained about the outer periphery of the upstanding side walls, with the first outer band 162 being at the top end of the upstanding side walls and the second outer band 164 being at the lower end of the upstanding side walls. Each side wall has the upper and lower bands. The first outer band 162 and the second outer band 164 are generally a strip of material attached to the upstanding walls by sewing means. The first outer band 162 and second outer band 164 provide added strength and support for the attachment of the upstanding side walls to the top panel 150 and the bottom panel 159 and provide protection against wear.

Figure 21:
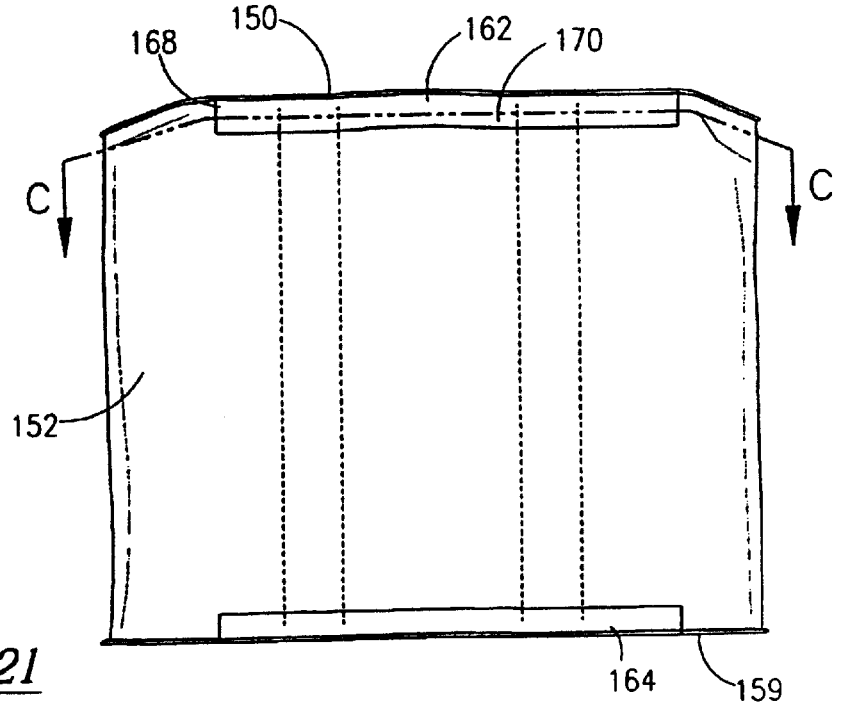
FIG. 21 is a front view of the most preferred embodiment illustrated in FIG. 20.

FIG. 21 is a front view of the most preferred embodiment shown in FIG. 20. Thus, the upstanding sidewall 152 is attached to the top panel 150 and the bottom panel 159 via conventional stitching. The top outer band 162 is also shown attached to the side wall 152 as well the bottom outer band via conventional stitching means. The other outer bands are attached in the same manner.

Referring to FIG. 22, a cross-sectional view of the container taken from line C—C of FIG. 21 will now be described. Thus, there is shown an inner bag 172 disposed within the container. The inner bag contains an inlet valve 174 for allowing the passage of the flowable materials into the inner bag 172. The inner bag 172 also contains a drain outlet 176 (which is also seen in FIG. 20), with the drain outlet 176 providing an outlet for the flowable materials within the inner bag. The drain outlet 176 may contain a valve member for the selective release of the flowable materials.

As seen in FIG. 22, the container has eight side beams 178,180,182,184,186,188,190,192 which are contained on the inner portion of the upstanding side walls. The eight side beams 178–192 are provided in sets of two so that each side wall contains two side beams. The eight side beams 178–192 are contained within inner sleeve means that stabilize and hold the side beams in an upright position. It should be noted that the there are other means that stabilize and hold the side beams in an upright position such as gluing and/or mechanical fastening, as previously noted. Thus, the side beams 178–192 are the inner means for resisting the lateral bulge force in an octagon resistance pattern to effect an equal diversion of the lateral bulge force about the upstanding side wall by providing lateral support as previously described. Note that even with the opening 160, top panel 150 still provides enough surface area for this octagon resistance pattern.

Figure 23:
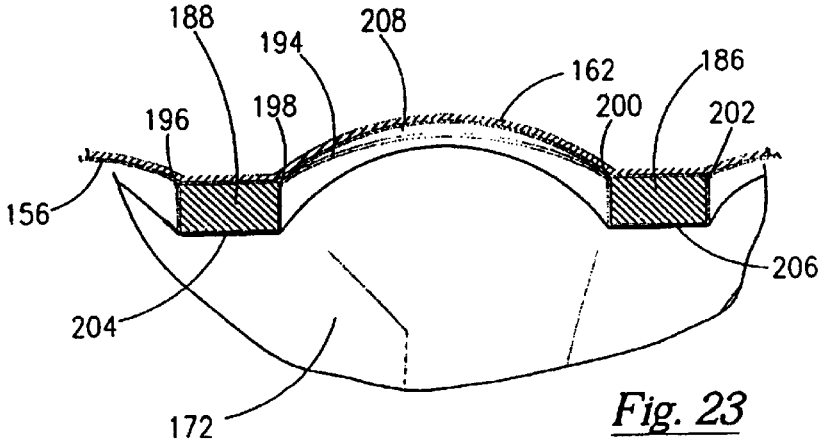
FIG. 23 is a magnified view of two inner side beam members within an inner pocket taken from FIG. 22.

In the embodiment shown in FIG. 23, which is a magnified view of a portion of the side wall panel 156, an inner sleeve means (sometimes referred to as pockets 194) is attached thereto. The pocket 194 is generally a sheet of material laid against the inner side wall 156. The pocket 194 is longitudinally sewn the length of the side wall 152 in four longitudinal planes, namely, 196,198,200,202. Thus, the side beam 188 is placed in the individual pocket 204, the side beam 186 is placed within the individual pocket 206 and there is nothing placed within the opening 208. Each of the inner side walls are configured in this manner with the corresponding side beams placed therein.

Figure 24:
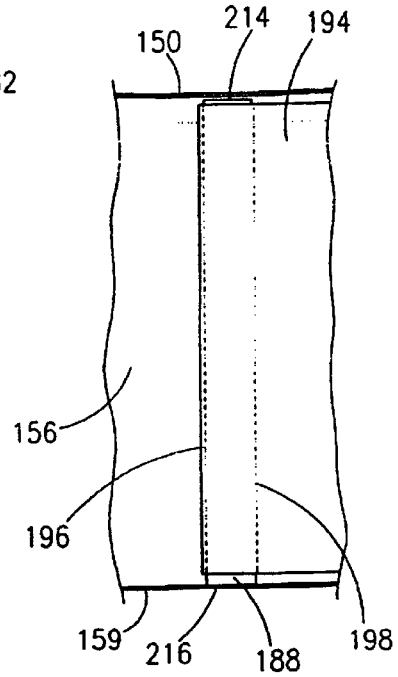
FIG. 24 is a longitudinal view of the inner side beam member seen in FIG. 23.

Referring now to FIG. 24, a longitudinal view of the side beam 188 placed within the pocket 204 will now be described. The pocket 204 has been sewn longitudinally downward by threads along the plane 196, 198. The side beam 188, which is a wooden member in the preferred embodiment, is disposed therein The side beams may be made of plastic, composites, metal, etc. The length of the pocket 204 extends substantially the entire length of the side wall. In the most preferred embodiment, the side beam 188 is approximately slightly shorter than the length of the side wall which allows the side beams to be installed. Once the bag 172 is filled, the top 214 of beam 188 contacts the top panel 150 and the bottom 216 of beam 188 contacts the bottom panel 159.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

I claim:

1. A flexible liquid container comprising:

a top panel having four sides, said top panel having an opening there through;

an upstanding side wall forming four sides, said upstanding side wall being attached to said top panel;

a bottom panel, said bottom panel being attached to said upstanding side wall panel, and wherein said top panel, said upstanding side wall panel and said bottom panel forming an inner chamber having four sides, said inner chamber containing a flowable material creating a force acting against said upstanding side wall;

four individual pockets attached to each of said four sides of said inner chamber, wherein each said individual pocket is a sheet of material laid against the inner side wall, said individual pockets being longitudinally sewn to attach the sheets of material in four longitudinal planes along the upstanding side wall;

eight side beams extending substantially vertically about said side wall panel in spaced relation;

and wherein said eight side beams create an eight point distribution that transfers the force exerted by said flowable materials to said top panel and said bottom panel for a symmetrical distribution of the force.

2. The container of claim 1 further comprising:

a bag disposed within said chamber, and wherein said flowable materials are disposed therein.

3. The container of claim 2 further comprising: an inlet formed on said inner bag, said inlet being configured to allow liquid to be flowed into said inner bag; and a drain disposed within said inner bag, said drain being configured to allow the depletion of the liquid within said inner bag.

4. A flexible container comprising:

a top panel having four sides;

an upstanding side wall forming four sides and having an inner portion and an outer portion, said upstanding side wall being attached to said top panel;

a bottom panel being attached to said upstanding side wall, and wherein said top panel, said upstanding side wall and said bottom panel form an inner chamber containing a flowable material creating a force acting against said inner portion of said upstanding side wall;

eight side post disposed about said inner portion of said upstanding side wall, said eight side posts being located about said inner portion of said upstanding side wall in sets of two along said four sides;

four individual pockets attached to each of said four sides of said inner chamber, wherein each said individual pocket is a sheet of material laid against the inner side wall, said individual pockets being longitudinally attached with means for attaching said sheets of material in four longitudinal planes along the upstanding side wall.

5. The container of claim 4 further comprising:

a bag disposed within said chamber, and wherein said flowable materials are disposed therein.

* * * * *